US012245665B2

(12) United States Patent
Ravelli

(10) Patent No.: US 12,245,665 B2
(45) Date of Patent: Mar. 11, 2025

(54) ELASTIC ATTACHMENT FOR A BELT

(71) Applicant: MAGIC SFEA S.R.L., Rudiano (IT)

(72) Inventor: Alessandro Ravelli, Rudiano (IT)

(73) Assignee: MAGIC SFEA S.R.L., Rudiano (IT)

( * ) Notice: Subject to any disclaimer, the term of this patent is extended or adjusted under 35 U.S.C. 154(b) by 0 days.

(21) Appl. No.: 18/340,138

(22) Filed: Jun. 23, 2023

(65) Prior Publication Data

US 2024/0285039 A1 Aug. 29, 2024

(30) Foreign Application Priority Data

Feb. 28, 2023 (IT) ..... 102023000003591

(51) Int. Cl.
*A44B 11/00* (2006.01)
*A44B 11/24* (2006.01)

(52) U.S. Cl.
CPC ..... *A44B 11/006* (2013.01); *A44B 11/24* (2013.01)

(58) Field of Classification Search
CPC ..... A44B 11/008; A44B 11/24; A44B 11/006
See application file for complete search history.

(56) References Cited

U.S. PATENT DOCUMENTS 1,463,172 A * 7/1923 Newman ..... A44B 11/008 24/309
1,678,417 A * 7/1928 Beck ..... A44B 11/24 24/163 R
2,087,151 A * 7/1937 Hornberger ..... A44B 11/008 24/163 R
2,619,697 A 12/1952 Legat
2,629,104 A * 2/1953 Easlick ..... A44B 11/008 2/322
3,150,427 A * 9/1964 Anacleto ..... A44B 11/24 24/163 R

FOREIGN PATENT DOCUMENTS

JP S5368328 U 6/1978

* cited by examiner

*Primary Examiner* — Robert Sandy
(74) *Attorney, Agent, or Firm* — Armstrong Teasdale LLP

(57) ABSTRACT

An elastic attachment for a belt having an outer body, an inner body slidingly arranged in an inner compartment of the outer body, and an elastic element that allows the inner body to return to the inner compartment is provided. Advantageously, the elastic attachment provides longitudinal elasticity to the belt to which the elastic attachment is applied without compromising aesthetic appearance of the belt.

11 Claims, 7 Drawing Sheets

ELASTIC ATTACHMENT FOR A BELT

CROSS-REFERENCE TO RELATED APPLICATION

This application claims priority to and benefit of Italian Patent Application No. 102023000003591 filed Feb. 28, 2023, the contents of which are incorporated by reference in their entirety.

FIELD OF THE INVENTION

The present invention pertains to an elastic attachment for a belt, e.g. one equipped with a buckle or plate or without a buckle and plate, which makes it possible to make the length of the belt adjustable, i.e., extendable and retractable, without the belt being unbuckled.

BACKGROUND OF THE INVENTION

A belt is formed of a belt body, made of leather or fabric, fitted with a buckle, clasp plate, or alternative clasp mechanism at one end.

In the case, for example, of belts for trousers, numerous efforts have been undertaken to impart longitudinal elasticity to the belt body in order to provide a better adaptation of the belt to the body throughout the day, whether when seated or standing. Belts are known that contain elastic inserts either throughout the entire length of the belt body or in sections of the belt; such solutions, however, not only undermine the belt's aesthetic appearance, but also have a tendency to wear out over time by losing their elastic function and are difficult to construct.

The essential requirements for an excellent belt are to maintain a streamlined structure, to be able to be easily inserted into garment loops, and to maintain a high degree of aesthetic appeal.

SUMMARY OF THE INVENTION

The object of the present invention is to provide an elastic attachment for a belt which complies with industry requirements while simultaneously remedying the aforementioned drawbacks.

In particular, the object of the present invention is to provide an elastic attachment capable of imparting longitudinal elasticity to the belt body without compromising its aesthetic appeal.

Moreover, the object of the present invention is to provide an elastic attachment that is not visible to the eyes of the user, enabling the belt to be extendable while maintaining the look of a conventional belt.

Also, it is the object of the present invention to provide an elastic attachment that is effective yet simple to construct.

Furthermore, it is the object of the present invention to provide an elastic attachment that adapts to different types of belts, such as belts with buckles, plates or other clasp systems.

This object is achieved by an elastic belt attachment and a belt as described and claimed herein. Advantageous embodiments of the present invention are also described.

BRIEF DESCRIPTION OF THE FIGURES

The features and advantages of the elastic attachment according to the present invention will become more evident through the following description, provided by way of non-limiting example with reference to the drawings in the accompanying figures, wherein.

DETAILED DESCRIPTION

Figure 1:
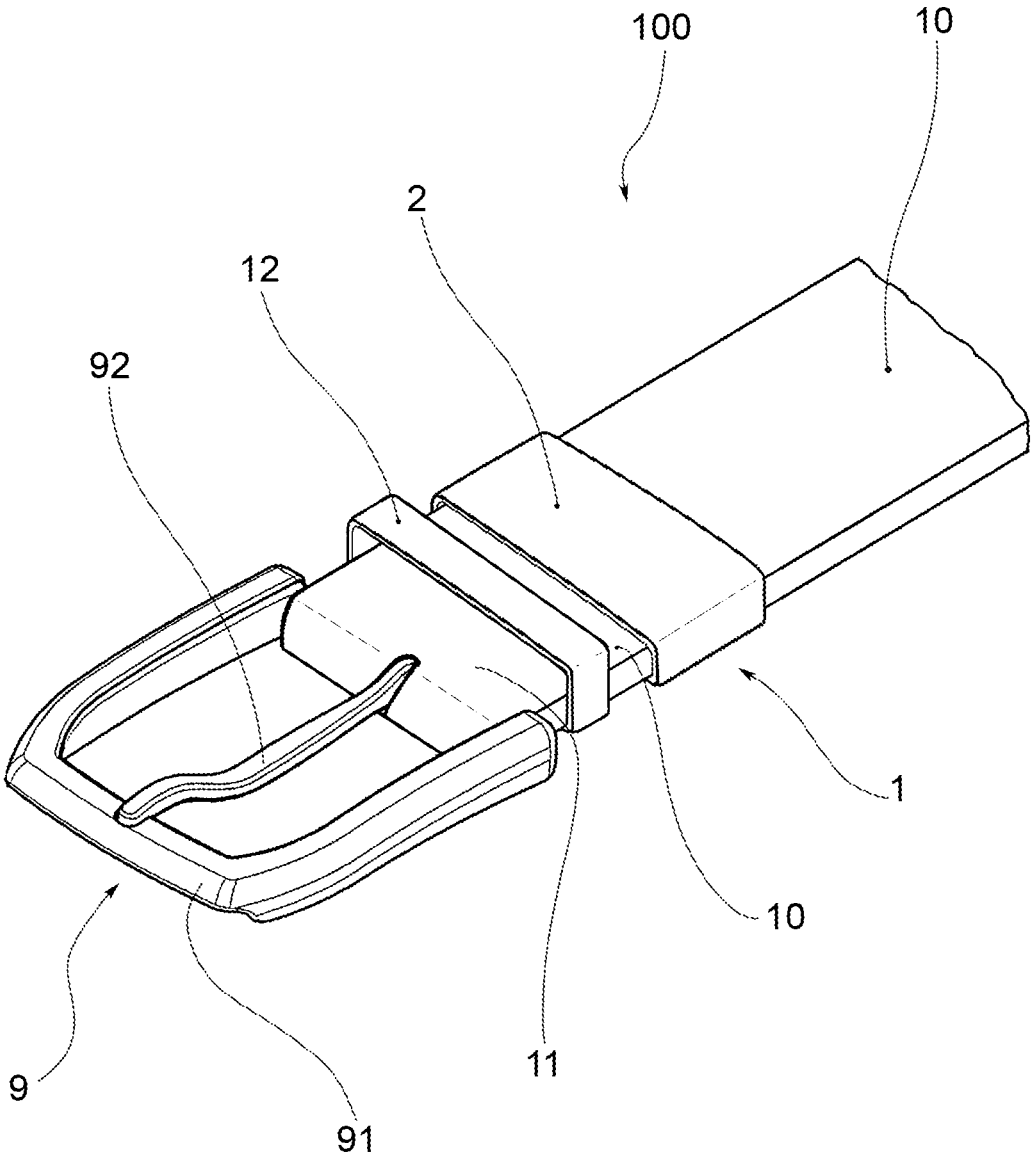
FIG. 1 depicts an elastic attachment according to the present invention, in an illustrative embodiment featuring a separate buckle.

A belt 100 according to the present invention comprises a belt body 10 made of leather or fabric or synthetic material, equipped with a clasp buckle 9 (or plate) at one end, and an elastic attachment 1. The elastic attachment 1 is positioned near the buckle 9, as in the illustrative embodiment in FIG. 1, or is integrated with the buckle 9, as in the illustrative embodiment in FIG. 3.

With reference to the attached figures, 1 has been used to indicate an elastic attachment according to the present invention.

The elastic attachment 1 comprises an outer body 2 equipped internally with an inner compartment 21 in which an inner body 3 is slidingly arranged, held in place inside said outer body 2 by at least one elastic element 4.

Figure 2A:
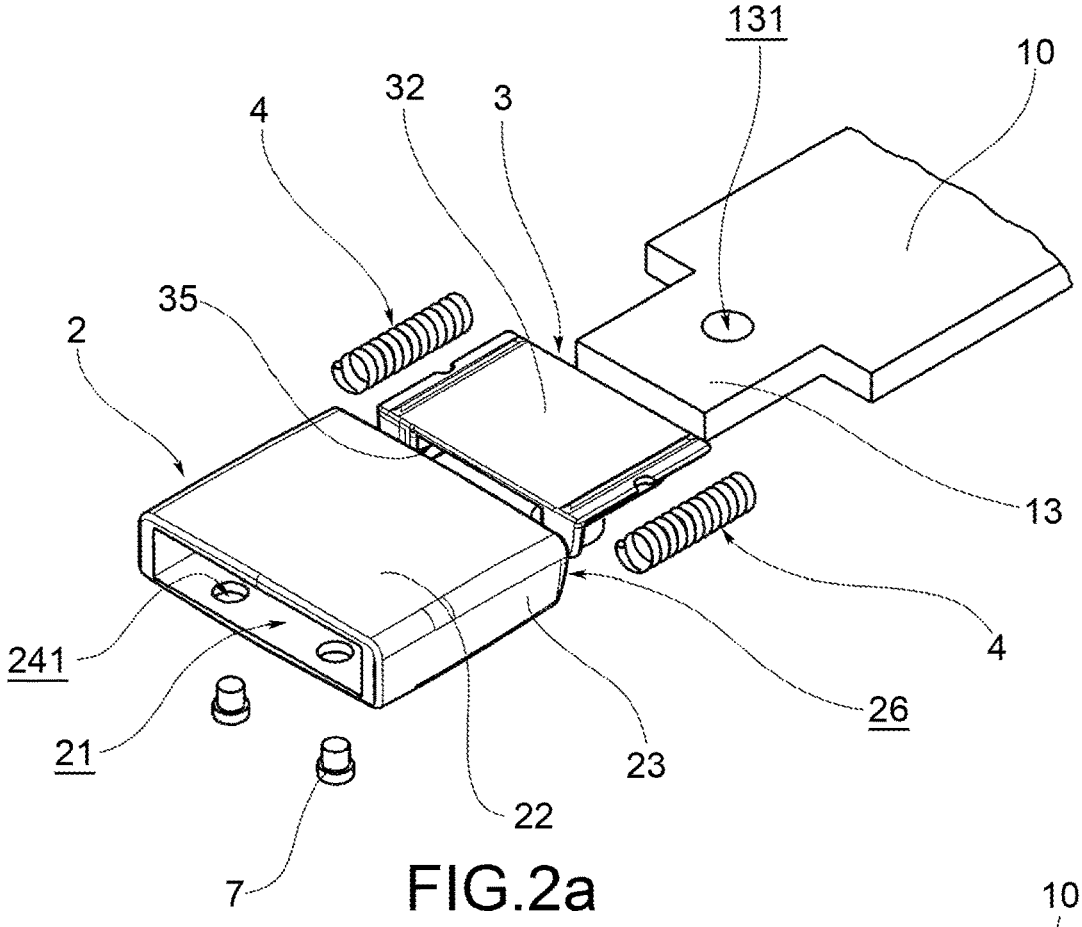
FIGS. 2*a* and 2*b* are exploded views, from above and below, respectively, of the elastic attachment in FIG. 1.
Figure 2B:
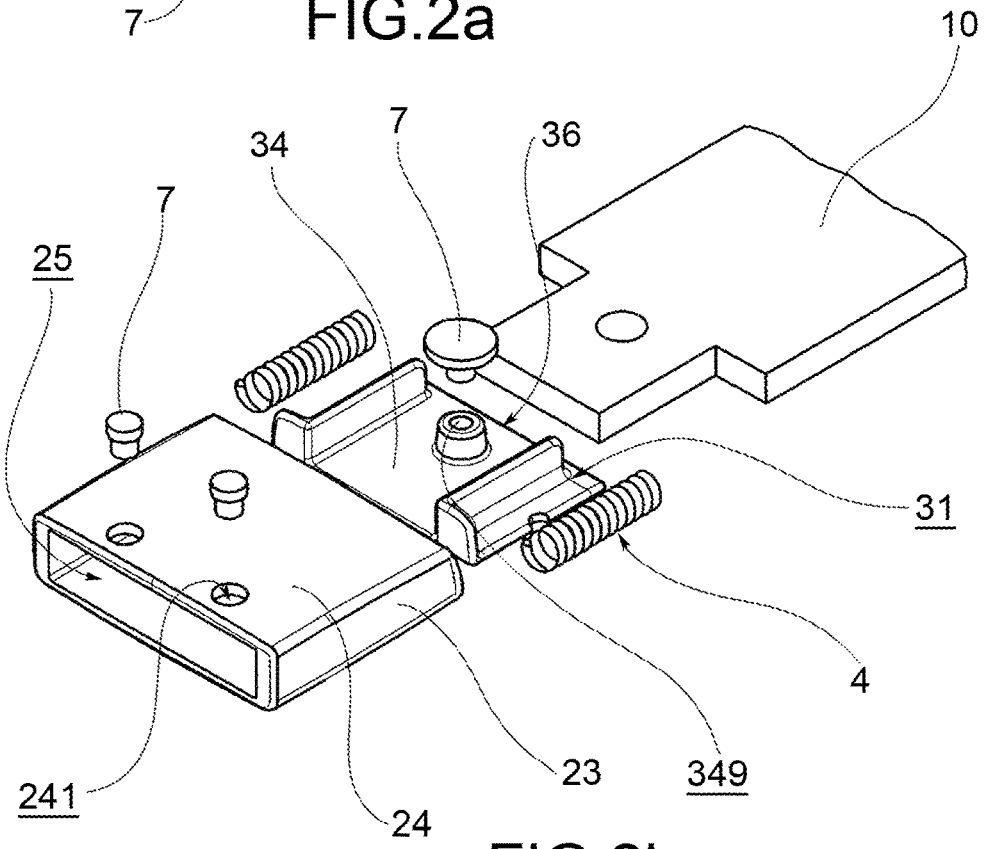

As shown in FIGS. 2*a* and 2*b*, the outer body 2 is provided with an upper face 22 and a lower face 24, joined by side walls 23. The outer body 2 has a front opening 25 and a rear opening 26 that provide entry to the inner compartment 21.

In the variant embodiment of FIG. 1, the lower face 24 of the outer body 2 is provided, near the front opening 25, with at least one securing hole 241, preferably a pair of securing holes, designed to be engaged by securing means 7 such as screws or self-drilling pins. In fact, in this variant embodiment, the elastic attachment 1 is designed for a belt 100 equipped with a buckle 9 distinct from the elastic attachment 1. The buckle 9 comprises a frame 91 and a barb 92, secured to a belt front part 11, distinct from the elastic attachment 1, preferably made of the same material as the belt body 10. The front part 11 of the belt, situated on the side opposing the one connected to the buckle 9, is connected to the outer body 2 of the elastic attachment 1. In particular, the terminal end of the front part 11 of the belt is inserted through the front opening 25 into the inner compartment 21 of the elastic attachment 1 and attached thereto through securing means inserted into the securing holes 241.

Preferably, this example also features a loop 12 made of the same material as the belt body 10.

Figure 4A:
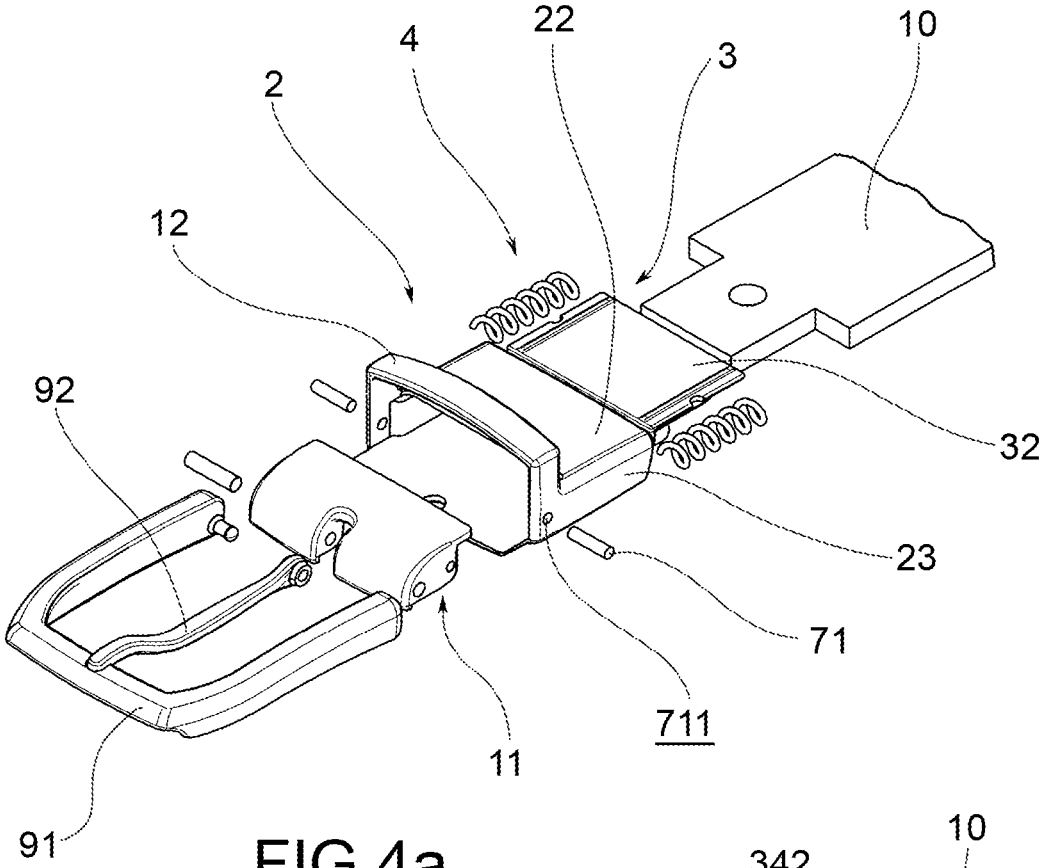
FIGS. 4*a* and 4*b* are exploded views, from above and below, respectively, of the elastic attachment in FIG. 1, in an illustrative embodiment.
Figure 4B:
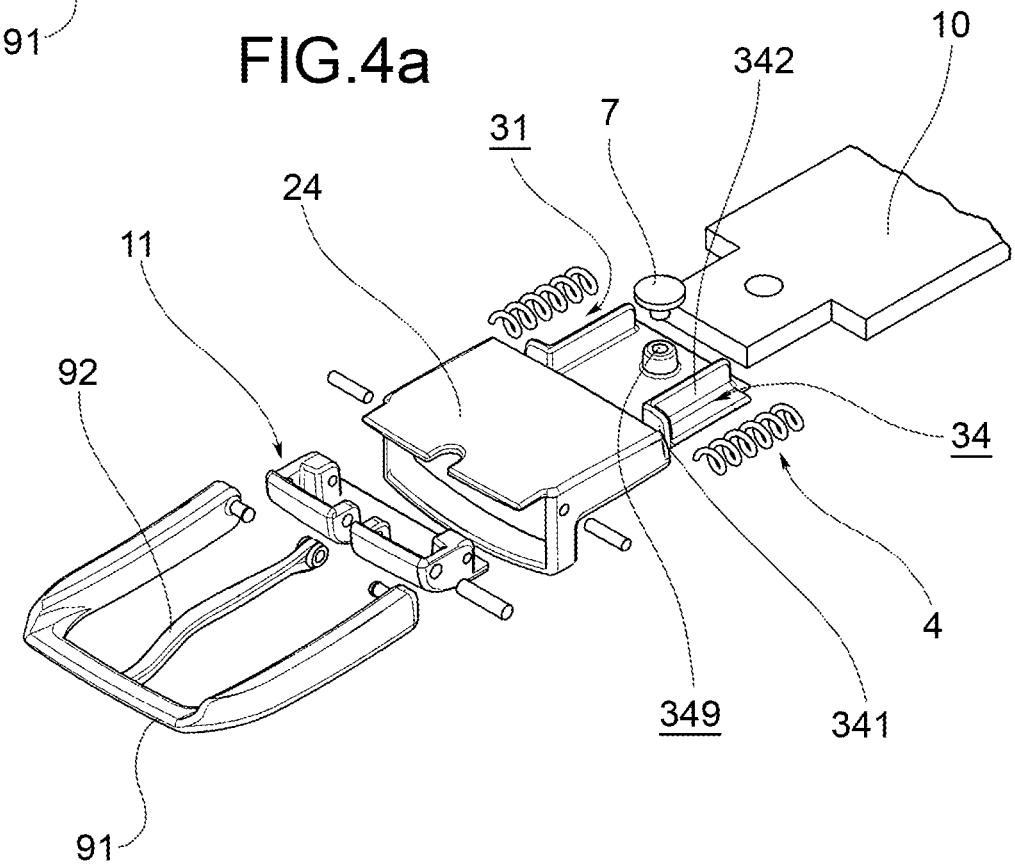
Figure 8A:
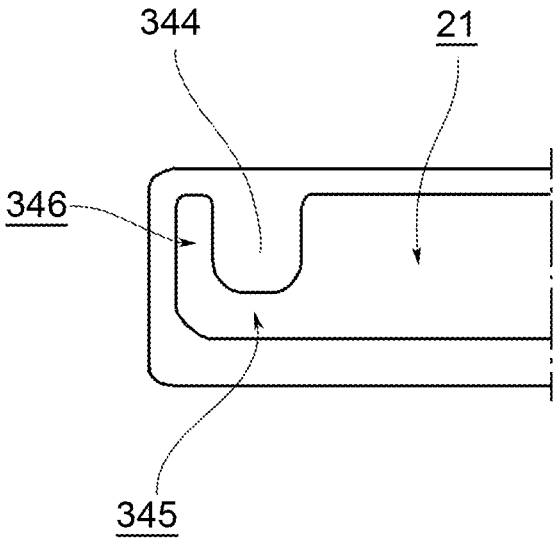
FIG. 8*a* depicts a detail of the elastic attachment 1, in particular the rear portion of an attachment.
Figure 8B:
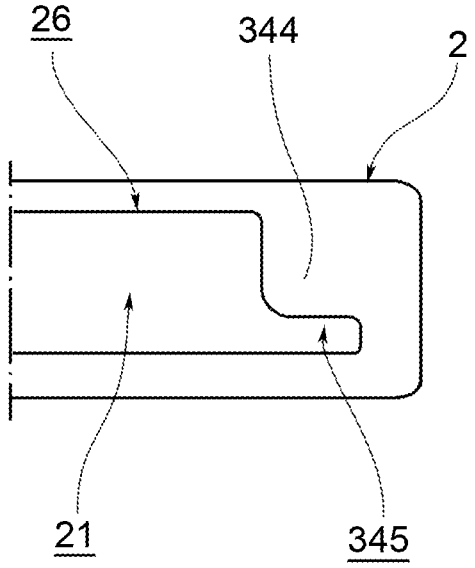
FIG. 8*b* shows a detail of the elastic attachment 1, in particular the rear portion of an elastic attachment from FIGS. 2*b* and 4*b*.

As depicted in FIGS. 8*a* and 8*b*, the outer body 2 is equipped with at least one backing wall 344, arranged laterally at the rear opening 26. In one illustrative embodiment, pertaining to the variant embodiments in FIGS. 2*b* and 4*b*, the backing wall 344 leaves a lower passage groove 345 (as depicted in FIG. 8*b*). In a further illustrative embodiment, pertaining to the variant embodiments in FIGS. 5*b* and 6*b*, the backing wall 344 leaves both a lower groove 345 and a side groove 346 (as in FIG. 8*a*).

As previously stated, the elastic attachment 1 comprises an inner body 3 secured within the outer body 2 by at least one elastic element 4.

The inner body 3 comprises an upper side 32, which is preferably flat and uninterrupted, as well as a lower side 34, a front side 35, and a rear side 36.

The lower side 34 of the inner body 3 is provided with at least one securing seat 349, near the rear side 36, preferably arranged centrally, intended to be engaged by securing means 7 such as screws, rivets, or studs. In fact, the free end 13 of the belt body 10, equipped with a securing hole 131, rests on the lower side 34 of the inner body 3 and is secured thereto by a securing means inserted concurrently into the securing hole 131 and the securing seat 349.

The inner body 3 is equipped with at least one housing 31 on the lower side 34 to at least partially accommodate an elastic element 4. Preferably, the inner body 3 comprises two housings 31 arranged laterally to the lower side 34.

The housing 31 is defined by at least three walls, namely the lower side 34, a bottom wall 341, and an inner side wall 342, as shown in the examples in FIGS. 2*b*, 4*b*, 5*b* and 6*b*. In this example embodiment, the backing wall 344 of the outer body 2 leaves a lower passage groove 345 (as in FIG. 8*b*) to allow the bottom wall 341 to pass through.

Figure 5A:
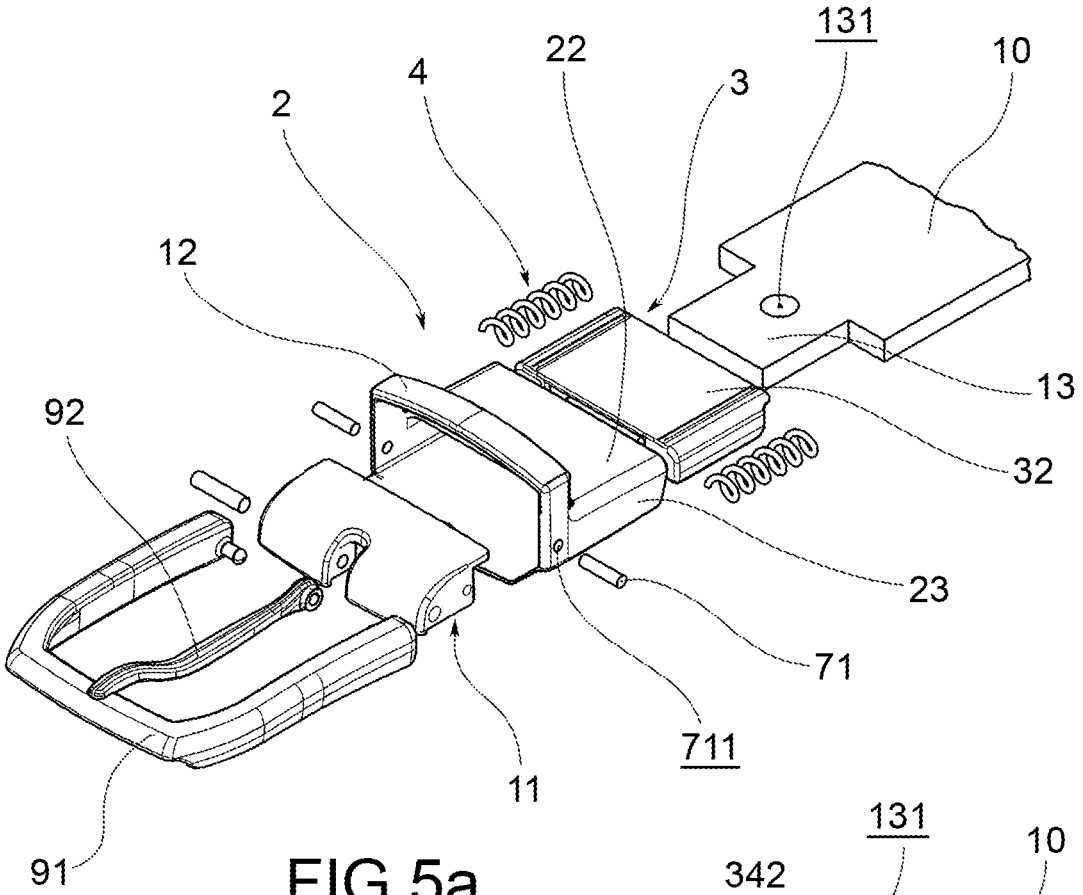
FIGS. 5*a* and 5*b* are exploded views, from above and below, respectively, of the elastic attachment in FIG. 1, in a further illustrative embodiment.
Figure 5B:
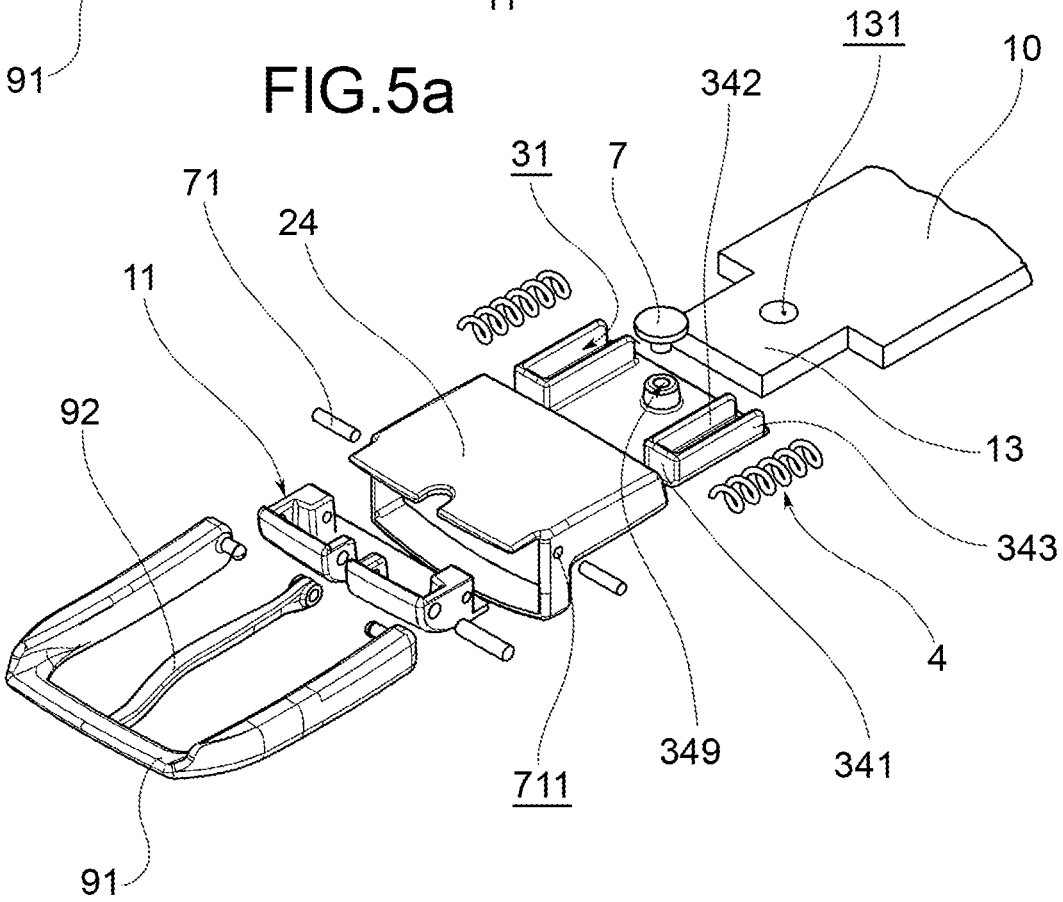
Figure 6A:
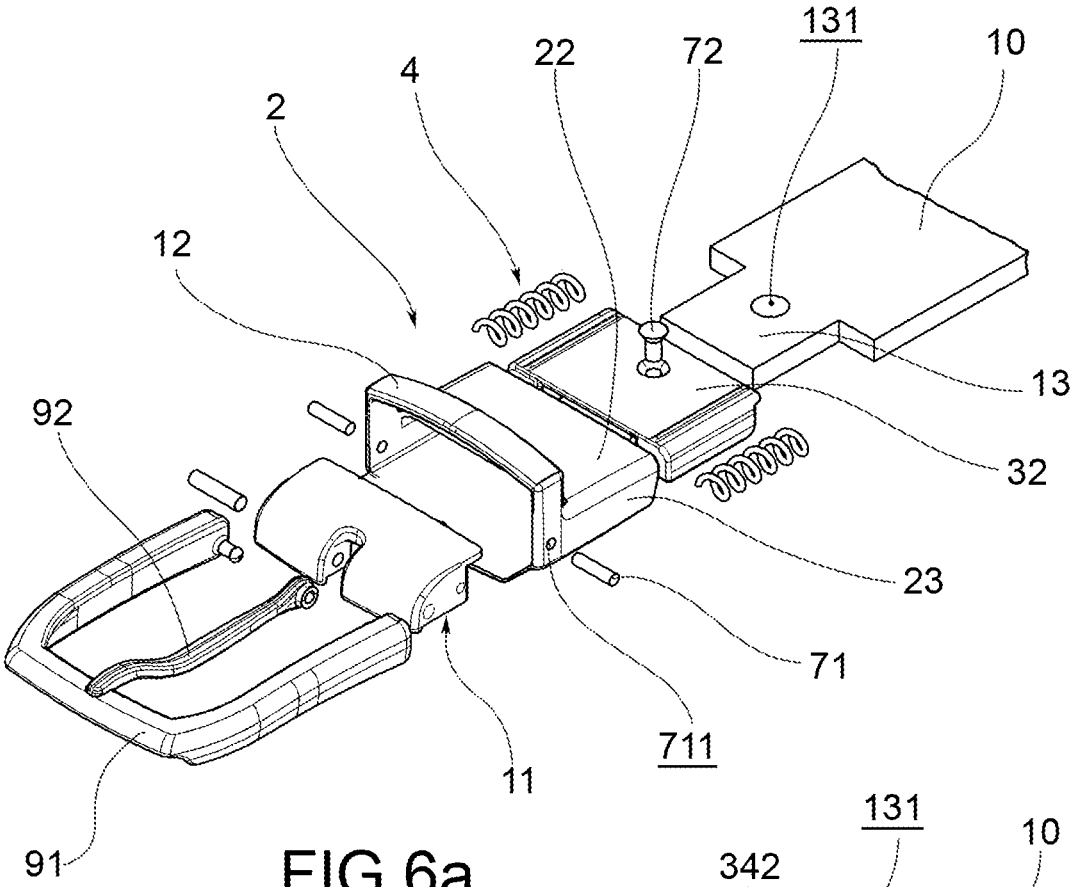
FIGS. 6*a* and 6*b* are exploded views, from above and below, respectively, of the elastic attachment in FIG. 1, in a still further illustrative embodiment.
Figure 6B:
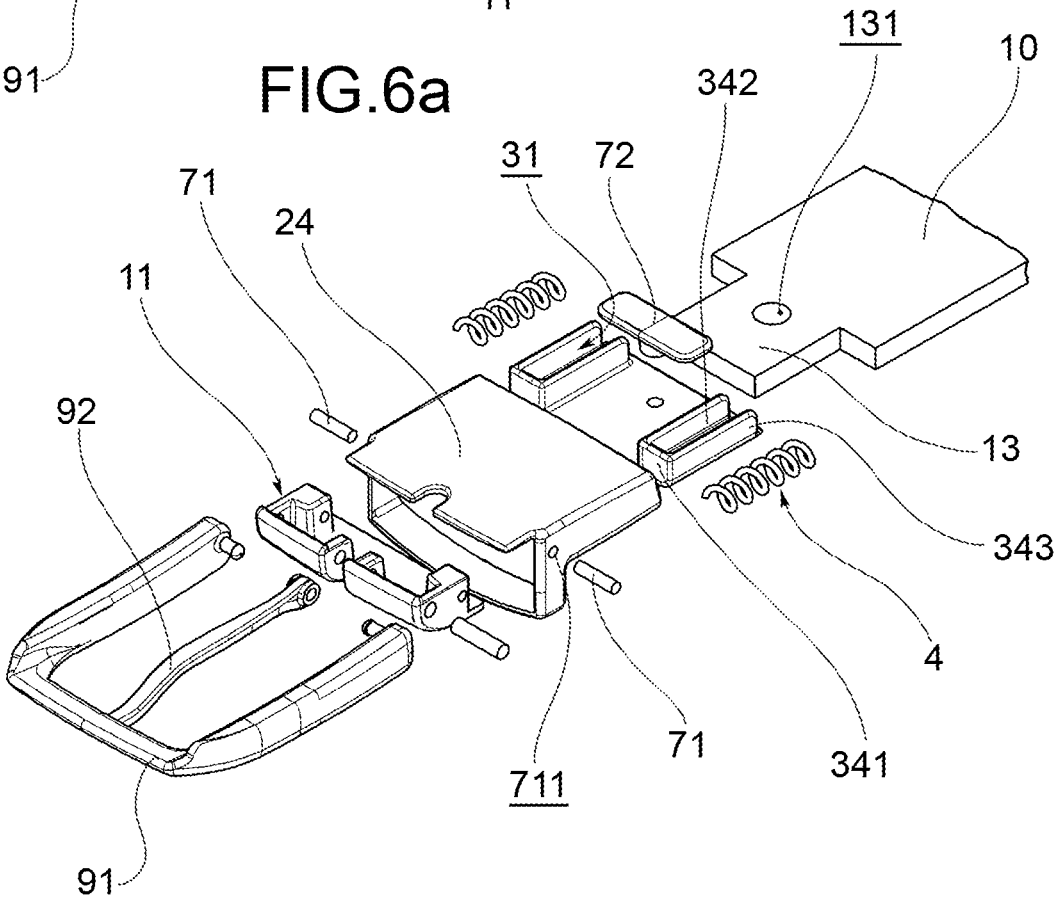

Preferably, the housing 31 is defined by at least four walls, namely the lower side 34, a bottom wall 341, an inner side wall 342, and an outer side wall 343, as shown in the examples in FIGS. 5*b* and 6*b*. In this illustrative embodiment, the backing wall 344 of the outer body 2 also leaves a side groove 346 (as in FIG. 8*a*) to allow the passage of the outer side wall 343 as well. In this example, the elastic element 4, usually a spring, is best contained by the four walls of the housing 31.

Figure 7:
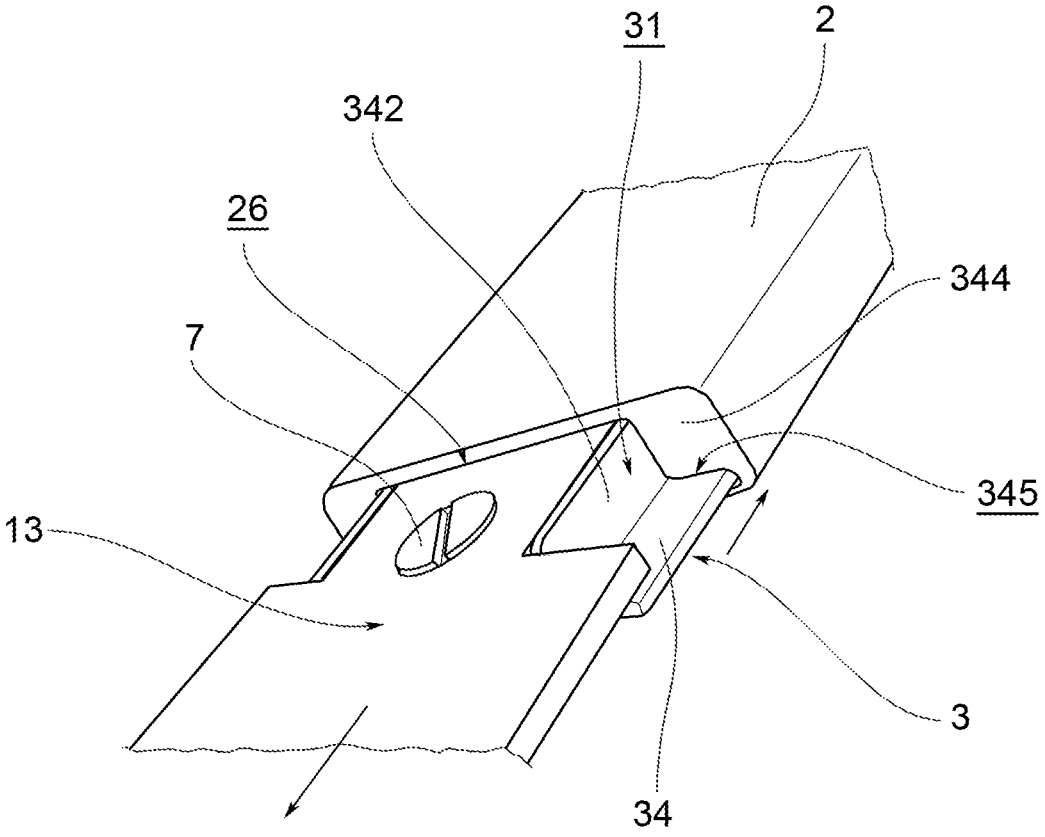
FIG. 7 depicts the elastic attachment in the utilization phase, i.e., in the elongation phase.

To assemble the elastic attachment 1, the inner body 3, which houses at least one elastic element 4 arranged in the corresponding housing 31, is inserted inside the inner compartment 21 of the outer body 2 through the front opening 25. Thus, the elastic element 4 is confined within the walls of the housing 31 of the inner body 3, and the lower face 24 and the backing wall 344 of the outer body 2. When the belt body 10 is pulled away from the elastic attachment 1, the inner body 3 partially protrudes from the outer body 2, as shown in FIG. 7. Simultaneously, the elastic element 4 is compressed between the bottom wall 341 and the backing wall 344, thereby storing energy and applying a commensurate tensile force to retract the inner body 3 within the outer body 2 upon release of the belt body 10.

Figure 3:
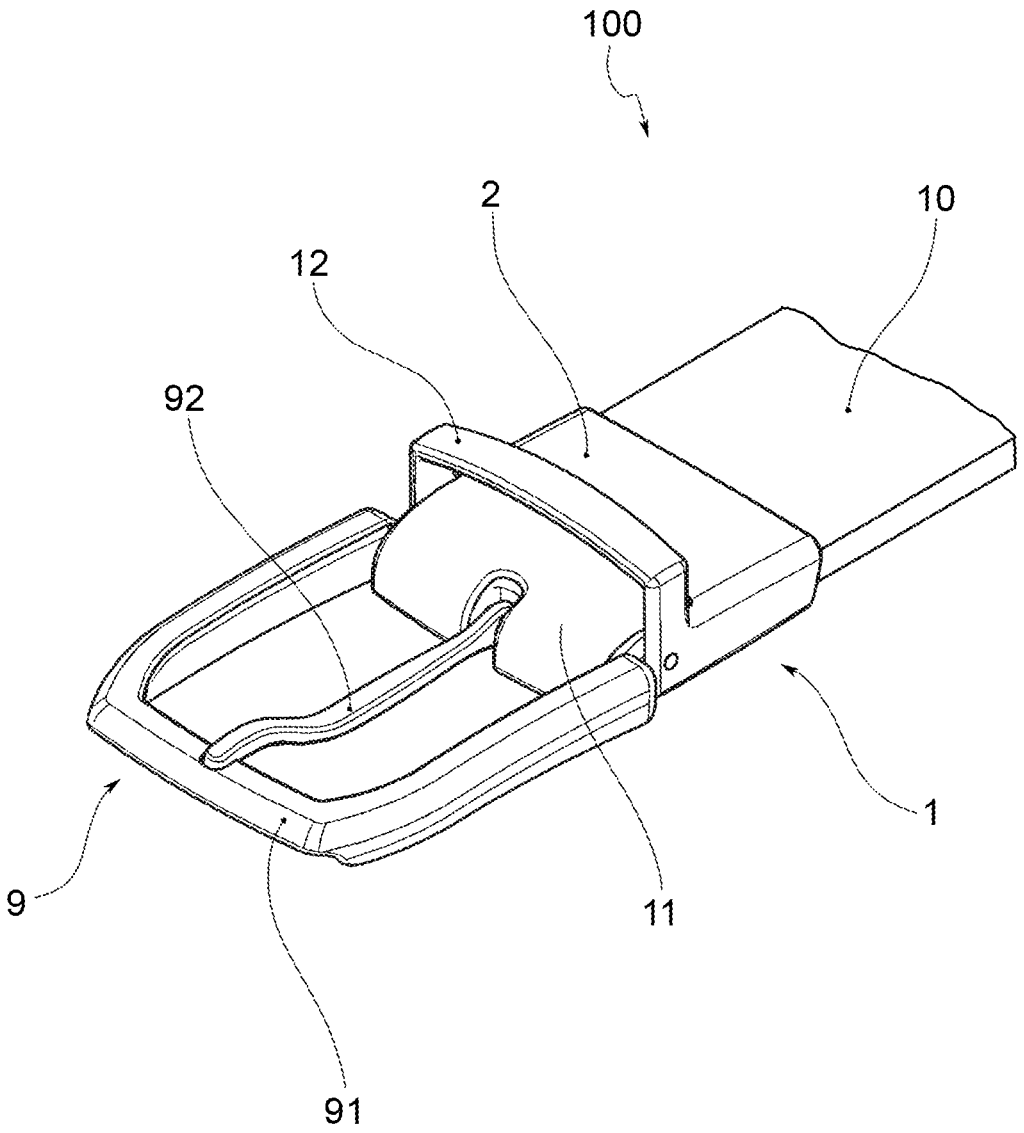
FIG. 3 depicts an elastic attachment according to the present invention, in an illustrative embodiment with an integrated buckle.

In the variant embodiment depicted in FIG. 3, the elastic attachment 1 is equipped with an integrated buckle 9. The buckle 9 comprises a frame 91 and a barb 92, fastened to a front part 11 that is part of the elastic attachment 1. The front part 11, on the side opposite to the side connected to the buckle 9, is connected to the outer body 2 of the elastic attachment 1. In particular, the terminal end of the front part 11 is inserted, through the front opening 25, into the inner compartment 21 of the elastic attachment 1, and secured thereto through securing means, e.g., pins 71 inserted into special securing holes 711 made in the side walls 23 of the outer body 2. Preferably, the aforesaid example also features a loop 12 made in one piece with the outer body 2 of the elastic attachment 1.

In the illustrative embodiment depicted in FIG. 5*b*, the lower side 34 of the inner body 3 is provided with at least one securing seat 349 near the rear side 36, preferably arranged centrally, intended to be engaged by securing means 7, e.g., screws, a rivet, or a stud, to establish the connection with the belt body 10.

In the illustrative embodiment depicted in FIG. 6*b*, the lower side 34 of the inner body 3 is provided with at least one passage near the rear side 36, preferably arranged centrally, designed to be engaged by securing means 72, e.g., a stud, to make the connection with the belt body 10.

Innovatively, an elastic attachment according to the present invention imparts longitudinal elasticity to the belt without compromising its aesthetic appearance.

Advantageously, the solution that is the subject of the present invention involves making the belt attachment elastic, and thus making the connection of the belt clasp system and the belt body elastic, rather than the belt body itself. This solution results in the elastic part blending in with the clasp, making it imperceptible to the eyes of the user. The belt is thus extendable while still maintaining the appearance, for all intents and purposes, of a conventional belt.

Advantageously, an elastic attachment in accordance with the present invention is effective yet simple to construct and assemble with the belt.

Advantageously, an elastic attachment according to the present invention fits different types of belts, including belts with buckles, plates, or other clasp systems.

It is clear that those skilled in the art may make changes to the device described above in order to meet incidental needs, all falling within the scope of protection as described and claimed herein.

What is claimed is:

1. An elastic attachment for a belt, comprising:

an outer body adapted to be secured to a buckle of the belt, provided with an inner compartment;

an inner body adapted to be secured to a belt body of the belt, slidingly arranged in the inner compartment of the outer body; and at least one elastic element arranged inside the inner compartment of the outer body, adapted to allow the inner body to return to the inner compartment, wherein said at least one elastic element is arranged in a housing of the inner body, said housing being defined by a lower side of the inner body, said bottom wall, and an inner side wall.

2. The elastic attachment of claim 1, wherein said at least one elastic element is arranged between a bottom wall of the inner body and a backing wall of the outer body.

3. The elastic attachment of claim 2, wherein said backing wall is provided with a lower groove to allow passage of the lower side of the inner body.

4. The elastic attachment of claim 1, wherein said housing is also defined by an outer side wall.

5. The elastic attachment of claim 3, wherein said backing wall is further provided with a side groove to allow passage of the outer side wall of the inner body.

6. The elastic attachment of claim 1, comprising a pair of elastic elements each arranged in a corresponding housing of the inner body.

7. The elastic attachment of claim 1, comprising a buckle with a frame and a barb, said buckle being secured to the outer body by a front part.

8. The elastic attachment of claim 7, wherein said front part is made of metal and connected to the outer body through securing means.

9. A belt comprising:

an elongated belt body;

a buckle secured to an end of the belt body; and an elastic attachment comprising:

an outer body adapted to be secured to the buckle of the belt, provided with an inner compartment;

an inner body adapted to be secured to the belt body of the belt, slidingly arranged in the inner compartment of the outer body; and at least one elastic element arranged inside the inner compartment of the outer body, adapted to allow the inner body to return to the inner compartment, the elastic attachment being secured to the belt body close to the buckle.

10. The belt of claim 9, wherein the buckle is connected to the outer body of the elastic attachment by a front part made of metal.

11. The belt of claim 9, wherein the buckle is connected to the outer body of the elastic attachment by a front part made of a same material as the belt body.

* * * * *